US006213364B1

(12) United States Patent
Wakefield

(10) Patent No.: US 6,213,364 B1
(45) **Date of Patent: *Apr. 10, 2001**

(54) SIGMATE SHAPED APPENDAGE FASTENING MEANS

(75) Inventor: James Theodore Wakefield, Palmdale, CA (US)

(73) Assignee: DEFS, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/270,801

(22) Filed: Mar. 17, 1999

(51) Int. Cl.[7] ..... A45C 1/04

(52) U.S. Cl. ..... 224/587; 224/191; 224/666; 224/667; 224/269; 224/232

(58) Field of Search ..... 224/191, 587, 224/195, 665–667, 242, 251, 268, 269, 271, 232, 234, 903, 930

(56) References Cited

U.S. PATENT DOCUMENTS 5,630,535 * 5/1997 Valenti ..... 224/271

5,881,938 * 3/1999 Wakefield ..... 224/587

* cited by examiner

*Primary Examiner*—Timothy L. Maust

(57) ABSTRACT

A rigid appendage fastening means that may be adapted to mount an apparatus that is commonly possessed and carried by law enforcement officers, military personnel and civilians, who are licensed to do so, diurnally. The appendage fastening means is specifically designed to be mounted to those items that the user intends to keep hidden from the view of a casual observer. The device's primary design characteristic is that of a loosely formed sigmate. The principal object is camouflaged to suit the user's apparel, thereby enhancing the device's covert characteristics and applications. The device provides the user with a secure environment to place an item inside the waistband (IWB) and below the belt line (BBL). Objects of appropriate size and utility, which have the principal object mounted to them, can be secreted upon the user's person IWB. Said object remains IWB, BBL with Total Concealment (TC), easily accessible, safe, secure, and immediately available for use. The invention is ergonomically designed so as not to restrict a user's freedom of movement, or range of motion.

8 Claims, 4 Drawing Sheets

SIGMATE SHAPED APPENDAGE FASTENING MEANS

CROSS-REFERNCE TO RELATED APPLICATIONS

Ser. No. 08/926,459; U.S. Pat. No. 5,881,938.

FED SPONSORED R & D

Not Applicable

REFERRENCE TO A MICROFICHE APPENDIX

Not Applicable

BACKGROUND OF INVENTION

1. Field of Invention

This invention relates to appendage fastening means that are most commonly associated with knifes, badge holders, reserve ammunition pouches, chemical irritant canisters and/or their holders, and inside the waistband (IWB) holsters.

2. Description of the Prior Art

The principal object is an appendage fastening means designed specifically for the purpose of allowing a Police Officer, member of the Military, Civilian and/or Security Guard trained and licensed to possess and carry certain items that are associated with their occupational specialties or personal safety needs in a covert fashion. Generally speaking, an appendage fastening means is formed from machined spring metal, in either a rectangle or square design; it is then combined with and/or affixed to other materials including leather, plastic, cloth or Velcro. It can then be affixed and/or mounted to a particular apparatus, object or thing. In the case of a knife, the appendage fastening means is generally affixed to the exterior portion of the handle; further, it is designed in an elongated rectangle. In the case of a handgun holster the appendage fastening means is affixed to the outer portion of said holster. Examples of these traditional appendages can be found on the following two U.S. patents: the Spyderco knife U.S. Pat. No. 4,347,655 and the Bianchi holsters clip U.S. Pat. No. 4,667,374.

The previously mentioned principal objects and their accompanying appendage fastening means are superbly crafted items; however, in their present form, neither of them possess an appendage fastening means that can provide the user with a means of total concealment (TC). With the principal object, TC is easily accomplished. In the Spydeco and Bianchi's current configuration when they are deployed (IWB), a casual observer would be able to clearly see each of the respective appendage fastening means and the attached knife and holster. The Spyderco knife has an appendage fastening means that can be seen protruding from a pocket or waistband. The Bianchi holster has an appendage fastening means that causes the holster to protrude from a user's waistband above the waistband when it is deployed.

During certain types of law enforcement operations the usefulness of a knife, handgun, ammunition, badge or chemical irritant can be enhanced by the user's ability to keep said object concealed from view. However, the object must be retained in a secure and appropriate manner, yet available for use at a moment's notice. There are occasions when on-duty, plain-clothes police officers' can not use a coat or other outer garment to conceal a handgun, badge, and reserve ammunition pouch, chemical irritant or knife.

Likewise, when an officer is off-duty, there will be occasions when he or she will not desire or be unable to use a coat, jacket or shirt to conceal the aforementioned paraphernalia.

In a situation where an armed and dangerous criminal has taken an on-duty police officer hostage, and the involved officer, subsequently loses and/or surrenders his or her primary service weapon, a concealed backup handgun and/or knife might spell the difference between survival and death. In the case of a concealed knife, one placed inside the waistband (IWB) and below the belt line (BBL), the hostage officer would have an option, at his or her disposal, to use the knife as a weapon of last resort.

The appendage fastening means of the preferred embodiment has been developed to provide an apparatus that subsequently has the invention mounted to it, a method of total concealment with a high degree of security. The principal object provides an innovative method for IWB storage capability, wherein the user has fingertip access to an important piece of self-defense equipment. Any appropriate apparatus including, but not limited to the following: knife, holster, badge holder, reserve ammunition pouch, chemical irritant canister or holster can have the principal object mounted and/or equipped with it. Once the principal object is affixed to it, the apparatus can successfully be secreted in a completely covert fashion BBL and IWB. The advantages of the principal object over other forms and designs of appendage fastening means, commercially produced and sold, will become fully apparent after a complete review of this writing and rendering, which are used to fully illustrate the invention's specifications.

BRIEF SUMMARY OF THE INVENTION

For the purposes of clarity and simplicity in this specification document, primary reference shall be made to the preferred means of attachment of the innovation to a knife, as depicted in FIG. 1. However, the invention may be applied to other apparatus, including but not limited to the following: badge holders, ammunition pouches, chemical irritant canisters and/or holders, keys, handgun holsters, cases and pouches. The adaptation of the principal object to a significant number of different types of apparatus should be considered universal; however, the nature and scope of this particular specification document limits an itemized accounting of all of those items. The invention is an appendage fastening means that provides the user with the option of IWB concealment for those items that he or she has occasion to use diurnally. The principal object may be crafted of various materials including but not limited to the following: thermoplastic, polymer, 41/40 hard steel, and spring steel, metal, composites and/or any combination thereof. The invention can be manufacture and attached to a knife at the factory, or it may be adapted to an object in an after-market fashion. The principal object can be adapted to a knife by simply loosening and removing the screw(s) which secure the factory installed appendage fastening means to it. The invention can then be installed as a replacement item. The invention is a rigid one-piece device with a contact plate, upon adaptation and mounting an apparatus, the device extends up, out and away from the object to which it is affixed. The principal object has a flared portion, which extends out and away from the connection plate segment of the device. The appendage portion is fashioned as a loosely formed letter "S." The invention is one that is specifically designed to be camouflaged, so as to match the user's wearing apparel; it drapes over a user's clothing, securing the knife inside the waistband (IWB) and below the belt line (BBL) affording the user Total Weapon Concealment (TWC). The arch union portion of the principal object that extends from the connection of the appendage fastening and the knife causes the object to be arrested at the waistband. Removable screws can be inserted and tightened at the individual sites of predrilled holes that are fabricated in the connection plate portion of the device. There is a notch cut from the side of the loosely formed "S;" it allows the appendage fastening means to remain positioned adjacent to a belt loop on the user's wearing apparel. The invention provides covert utility, within the user's wing span.

DETAILED DESCRIPTION OF THE INVENTION

Figure 1:
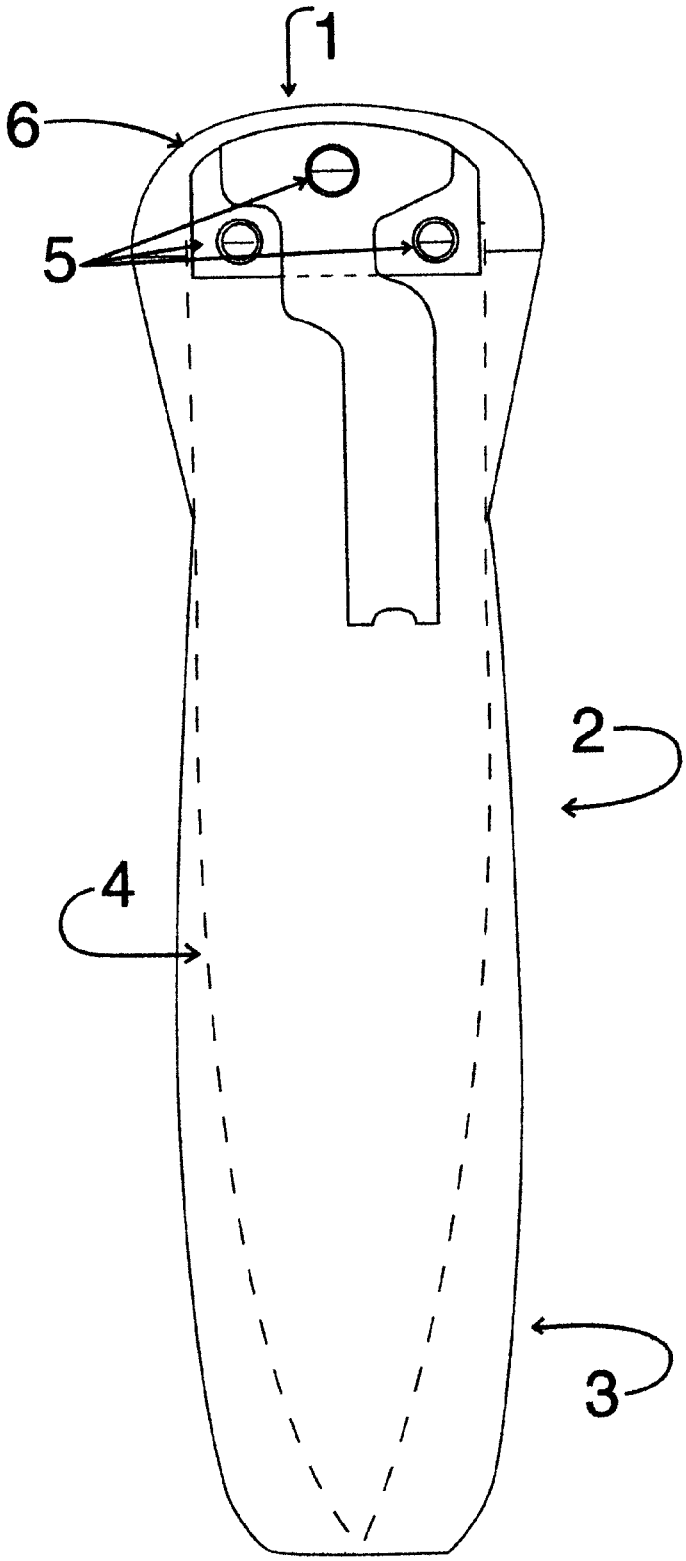
FIG. 1 is a side view of a knife equipped with the principal object formed in accordance with the invention.

The accompanying drawings and FIG. 1 in particular, is a disclosure of the preferred embodiment of the appendage fastening means 1 made according to the principal object. The principal object includes: a contact plate, an access port to allow screws or similar affixment apparatus to pass through it, a connection/union portion, and a bowed and tapered fastening means. The appendage portion of the principal object takes on the appearance of a loosely formed letter "S" with a notch cut from it. The invention is depicted by itself in FIG. 2. In addition to depicting the device, FIG. 1 also depicts a folding knife 2, the knife's two sided handle 3, a single locking blade 4, three, separate and individually removable screws 5, and the location on the knife where the appendage would most commonly be mounted 6. A blade is contained within the handle portion of the knife and it can be manually removed from and returned to the confines of the handle. The blade locks into a fixed position out from the handle; it can also be returned inside the handle manually. The user need only release the blades locking mechanism. The principal object can be adapted and attached to numerous makes, models and types of knifes which come equipped with a factory-installed appendage fastening means. The invention can easily be adapted to knifes that have a traditional appendage fastening means already mounted to them. As has been mentioned previously, for the purposes of simplicity and clarity, primary reference will be made only to the attachment of the invention 1 to a knife, as is depicted in FIG. 1.

The knife 2 is sold commercially with a prefabricated factory installed metal, one piece, removable appendage fastening means. The appendage fastening means may be removed by loosening the three metal screws that are used to attach it. The invention can be easily received at the handle of a knife. The invention's lazy "S" design characteristics are such that the device can be placed IWB, and then draped over and subsequently concealed behind portions of a user's wearing apparel. The appendage fastening means can be shielded, after it is placed in the waistband, when the user causes a small portion of his or her apparel to be bloused above it. Further, in normal use, the appendage fastening means will have occasion to extend behind a user's belt and belt loop. The appendage is constructed and manufactured in such a way that the device is camouflaged to specifically suit the user's wearing apparel, thus enhancing its covert nature and utility.

Figure 2:
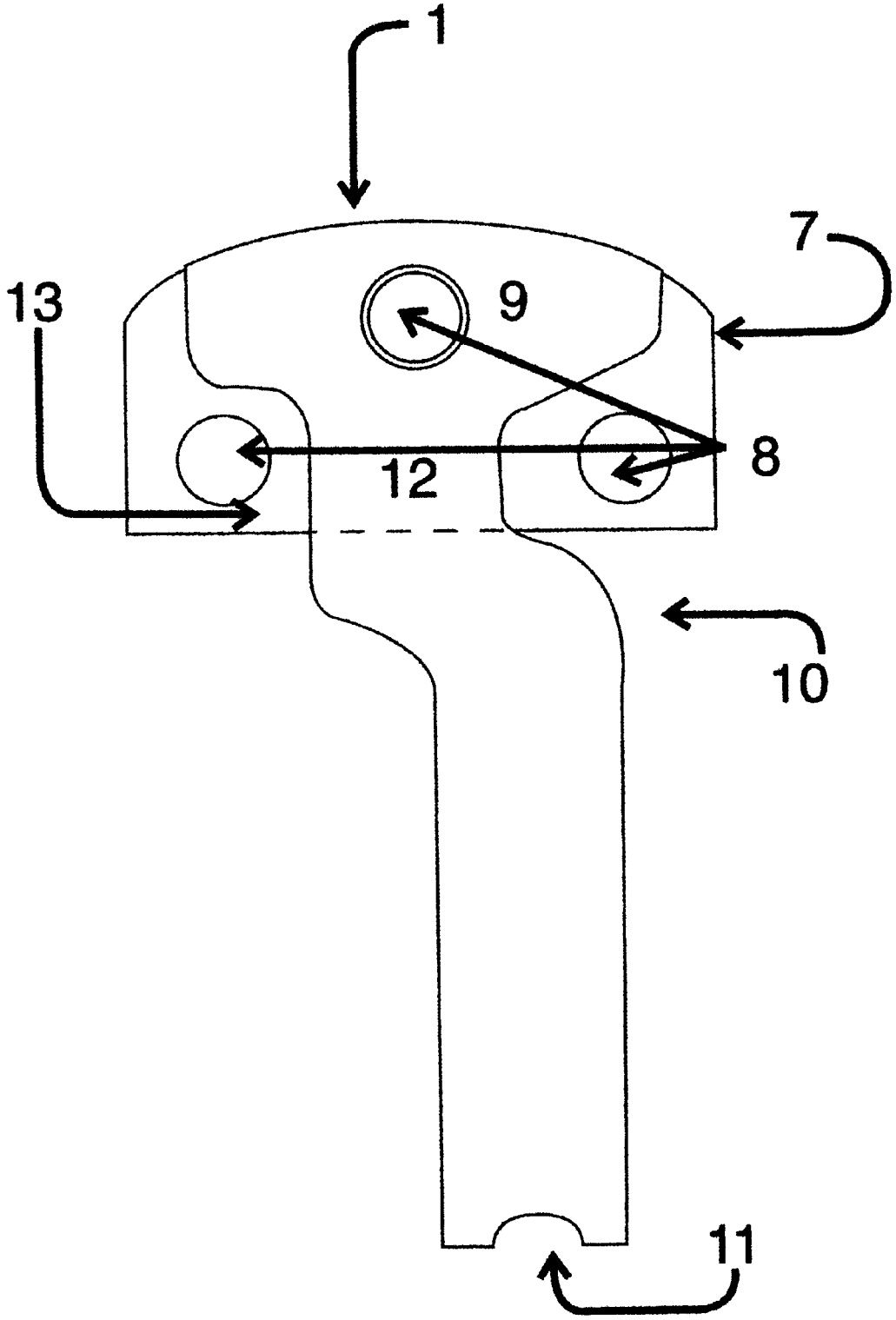
FIG. 2 is a side view of the preferred embodiment of the principal object as depicted in FIG. 1.
Figure 3:
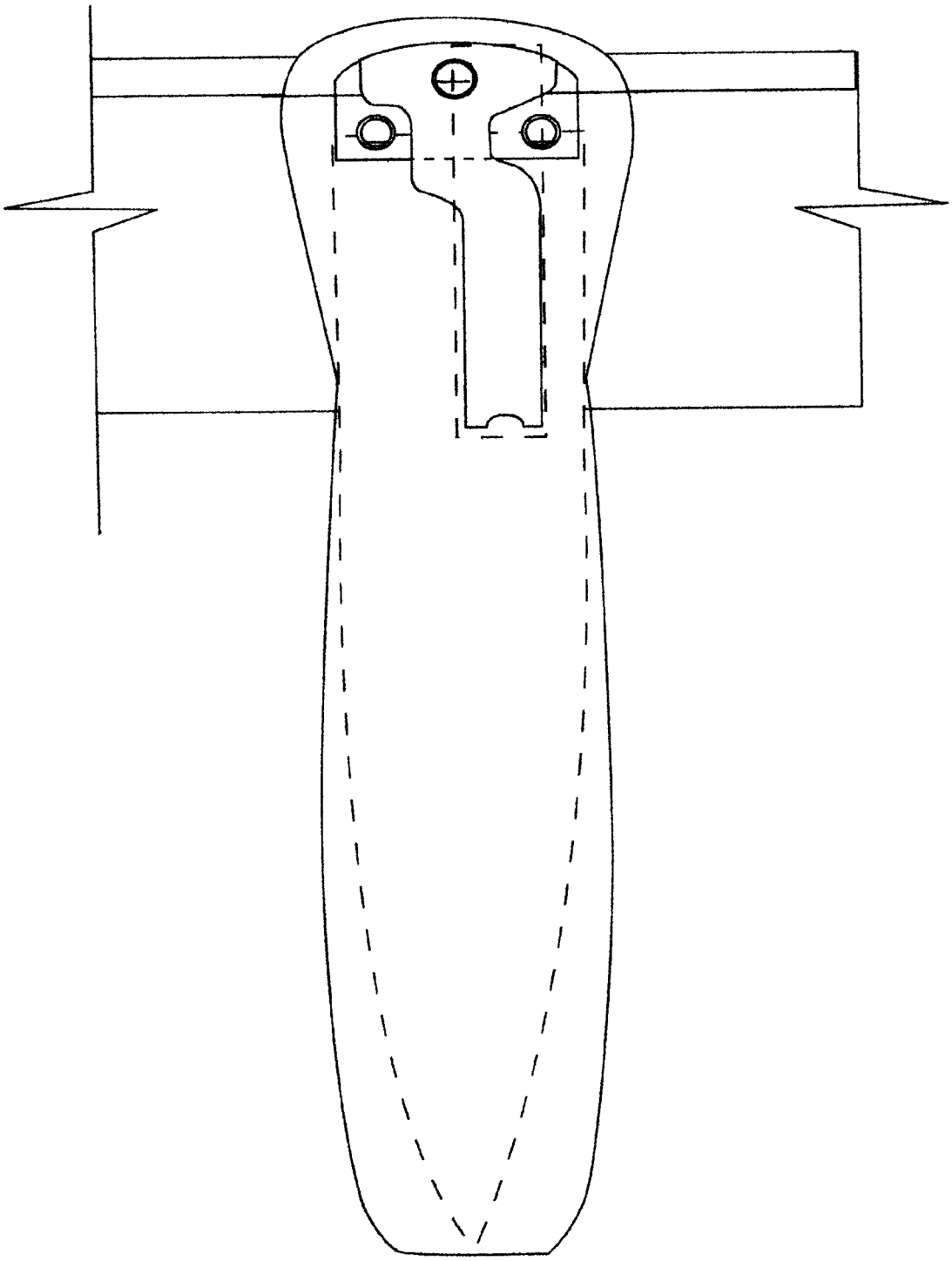
FIG. 3 is a side view of the principal object depicted in FIG. 1, showing the device in an operational position, below the waistband, with a portion of the invention and knife shown by dotted lines.
Figure 4:
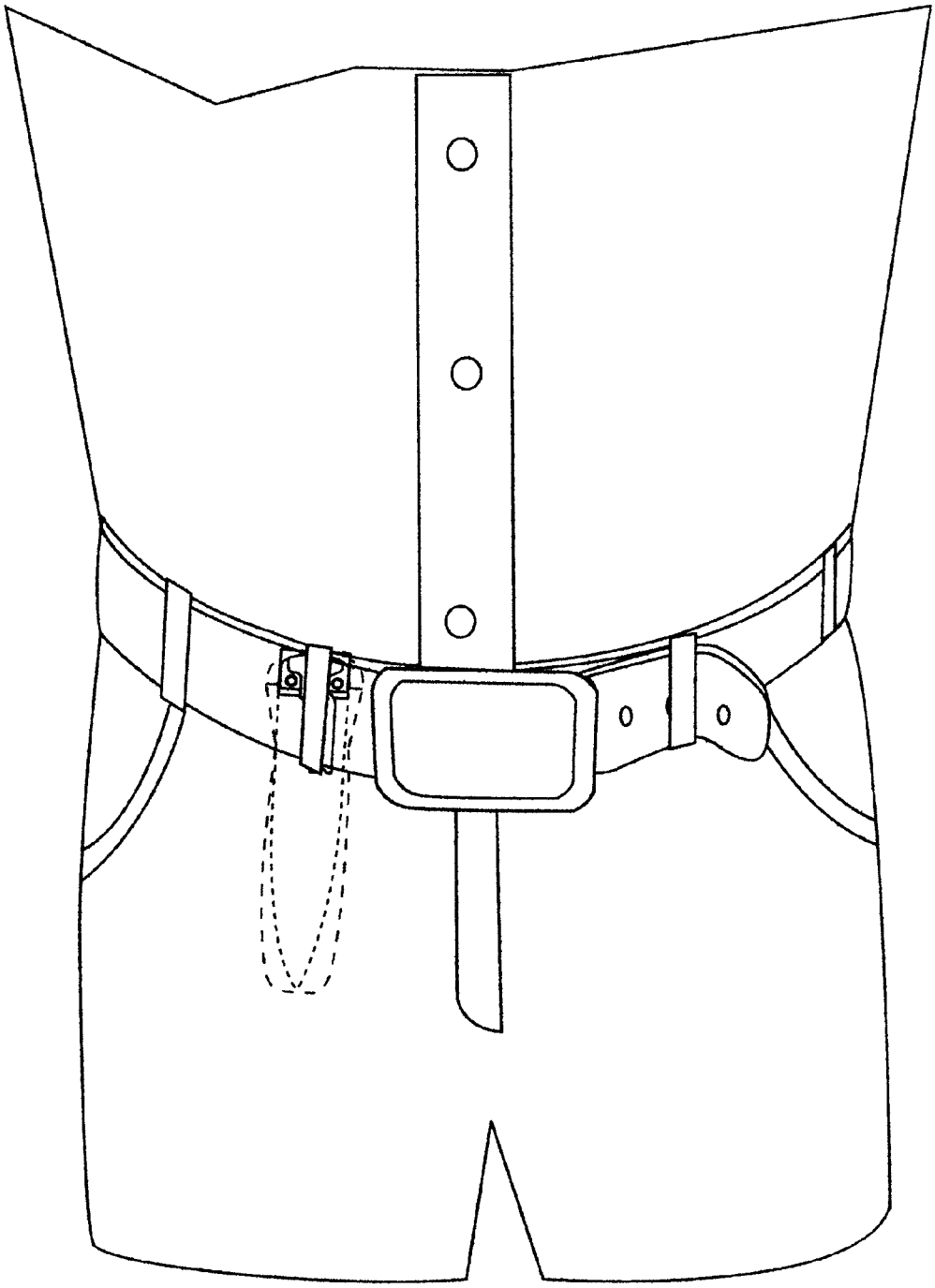
FIG. 4 is a partial view of a torso with the invention and knife positioned as it would be when deployed inside the waistband and below the belt line.

The principal object, FIG. 2 can be adapted to a knife when the user desires to conceal a knife and decides to carry said knife IWB. The invention and object it has mounted will go unnoticed by a casual or trained observer. FIG. 3 depicts the principal object in operation; it is shown affixed to the exterior portion of a knife handle. The depiction demonstrates how the lazy "S" appendage drapes onto and then over a user's wearing apparel. FIG. 4 depicts a knife as it would appear when deployed; it is depicted as would be after settling between the user's torso and clothing. The inventions connection plate 7 is mounted directly on the knife. Once the connection plate portion of the invention is mounted on the handle of the knife, it remains steadfast against the knife handle portion, the appendage portion then begins to bend up, out and away from the knife in a curvilinear fashion. The apparatus may be secured to the knife by inserting screws into the pre-drilled holes 8 on the connection plate, access to the centermost pre-drilled hole may be obtained through an access port 9. Once the screws are inserted they are to be taut. The loosely formed "S" 10 curves and turns behind the user's belt and belt loop. The terminal portion of the invention 11 has a lunate shaped segment that helps to stabilize the principal object behind a belt loop, when in use. The notch 12 on the appendage portion of the fastening means allows the user's belt loop to fit snuggly within the prefabricated opening. The flared portion located beyond the connection/union portion 13 drapes over the user's apparel at the waist line.

Since the preferential embodiment of the principal object has been duly described and depicted in detail, it should be clearly and fully apparent, to anyone skilled in the art, that any of a number of physical modifications and/or changes may be made to the aforementioned invention without altering the inventions concept or the principal nature of its embodiment. The principal object is to be considered in all aspects as illustrative and not restrictive. The full scope of the principal object is indicated by the appended claims. Any and all changes and/or variations, which may come, or happen to fall, within the scope meaning and range of any and all equivalencies of the following claims, are to be embraced therein.

I claim:

1. A unibody coupling plate and rigid appendage fastening means, which is specifically designed for adaptation to mount an object, facilitating total concealment, inside the waistband of a user's wearing apparel, completely below the belt line, secreting said object and fastening means from view, comprising:

a plano-convex coupling plate conjoined to an appendage fastening means that is shaped to resemble a loosely-formed letter "S,"adapted to be mounted on a device, wherein said appendage fastening means transversely extends across the latitudinal plane of the coupling plate.

2. The object as recited in claim 1, wherein the appendage fastening means portion completes a 180 degree rotation up, out and away from a connection/union point with the coupling plate portion, arching and extending to a terminal part, thereby creating a curvilinear configuration, achieving an "S" like form by proceeding laterally to a point where directional transition occurs, hence said appendage turns and sweeps downward to another directional transition, hence the appendage proceeds in a linear fashion to said terminal part.

3. The object as recited in claim 2, wherein that portion of the principal object that leads from the coupling plate to the arched union/connection is curved so as to avoid obtrusive and sharp angles to ensure that the appendage fastening means does not project itself harshly into the user's hand and does not interfere with the user's grip when drawing, exhibiting or using it.

4. The object as recited in claim 1, wherein the appendage fastening means has a flared base at it's connection/union to the edge of the coupling plate, at the connection/union said appendage fastening means is at its maximum width, tapering down in width as said fastener moves laterally away from the edge of the coupling plate, achieving its most narrow width through the terminal part, thereby facilitating concealment of the appendage fastening means behind the belt loop located at the waistband of a user's wearing apparel.

5. The object as recited in claim 2, wherein the appendage fastening means portion has a notch carved from it at a point adjacent to the flared base, said notch facilitates the receipt and concealment of the appendage fastening means behind a portion of a belt loop located at the waistband of a user's wearing apparel.

6. The object as recited in claim 2, wherein a lunate (crescent) shaped configuration, fashioned at the terminal part of the appendage fastening means portion, pinches down on and about a specific segment of a user's belt loop material causing the appendage to remain at the rear of said belt loop, hidden from view.

7. The object as recited in claim 1, wherein the exposed exterior surface of the appendage fastening means, or that portion of the principal object capable of being observed by the naked eye, is camouflaged to suit the apparel of the user, and wherein the underside of the appendage fastening means, that portion of the principal object that comes into contact with the user's clothing, is nonporous, flat and smooth, facilitating unobstructed movement when drawn, and wherein the exposed surface of the appendage fastening means, that portion of the principal object that has occasion to come in contact with the user's hand and/or palm is of a porous nature, so as to facilitate a sure and positive grip, and wherein the arched union/connection between the coupling plate and the appendage fastening means is level and straight so as to prevent canting and/or tilting of the device when the principal object has been adapted to a device and subsequently deployed for use.

8. The object as recited in claim 1, wherein the coupling plate has predrilled hole openings, and wherein the appendage fastening means has a hole opening centralized in the flared base portion in alignment with a hole on the coupling part allowing a treaded fastener to pass through to the hole opening on the coupling plate, which hole openings accommodate threaded fasteners for securing the coupling plate to the device.

* * * * *